US008182971B2

(12) United States Patent
Koike et al.

(10) Patent No.: US 8,182,971 B2
(45) Date of Patent: May 22, 2012

(54) RESIN FOR TONER AND TONER COMPOSITION

(75) Inventors: Masanori Koike, Kyoto (JP); Yasuhiro Ono, Kyoto (JP)

(73) Assignee: Sanyo Chemical Industries, Ltd., Kyoto (JP)

( * ) Notice: Subject to any disclaimer, the term of this patent is extended or adjusted under 35 U.S.C. 154(b) by 590 days.

(21) Appl. No.: 11/921,134

(22) PCT Filed: May 26, 2006

(86) PCT No.: PCT/JP2006/310531

§ 371 (c)(1),
(2), (4) Date: Aug. 10, 2009

(87) PCT Pub. No.: WO2006/126667

PCT Pub. Date: Nov. 30, 2006

(65) Prior Publication Data

US 2009/0305157 A1 Dec. 10, 2009

(30) Foreign Application Priority Data

May 27, 2005 (JP) ..... 2005-155182

(51) Int. Cl.
*G03G 9/00* (2006.01)

(52) U.S. Cl. ..... 430/109.4; 525/418; 528/271; 528/272; 528/296

(58) Field of Classification Search ..... 430/109.4; 525/418; 528/271, 272, 296
See application file for complete search history.

(56) References Cited

U.S. PATENT DOCUMENTS

| | | | |
|---|---|---|---|
| 4,960,664 | A | 10/1990 | Yamada et al. |
| 5,830,979 | A | 11/1998 | Nakayama et al. |
| 2001/0051309 | A1 * | 12/2001 | Nagahama et al. ..... 430/108.23 |

FOREIGN PATENT DOCUMENTS

| | | |
|---|---|---|
| EP | 1 186 962 | 3/2002 |
| GB | 2 289 950 | 12/1995 |
| JP | 05-080586 | 4/1993 |
| JP | 06-027728 | 2/1994 |
| JP | 09-251216 | 9/1997 |
| JP | 11-153884 | 6/1999 |
| JP | 11-249339 | 9/1999 |
| JP | 2000-321819 | 11/2000 |
| JP | 2001-125307 | 5/2001 |
| JP | 2002-318471 | 10/2002 |
| JP | 2004-184561 | 7/2004 |
| JP | 2004-271859 | 9/2004 |
| JP | 2005-062517 | 3/2005 |
| JP | 2005-128122 | 5/2005 |

OTHER PUBLICATIONS

Extended European Search Report mailed Jun. 24, 2011, in corresponding European Patent Application No. 06756631.5.
Notification of Reason for Refusal dated Sep. 28, 2010, in corresponding Japanese Patent Application No. 2006-146389 (with English translation).
International Search Report for PCT/JP2006/310531.

* cited by examiner

*Primary Examiner* — Mark A Chapman
(74) *Attorney, Agent, or Firm* — Edwards Wildman Palmer LLP

(57) ABSTRACT

A toner and a resin for toner are provided which are of good low-temperature fixing ability and good anti-blocking property of toner at high temperature and high humidity and good pulverisability. The present invention is directed to a resin for toner, the resin comprising a polyester resin (A) produced by reacting a polyester resin (a) having an acid value of 6 mgKOH/g or less and a hydroxyl value of 10 to 80 mgKOH/g with at least one carboxylic acid (b) selected from the group consisting of aliphatic carboxylic acids, aromatic carboxylic acids, their anhydrides and lower alkyl (C1-C4) esters, wherein the equivalent ratio OHa/COOHb is 0.55 to 1.0 where OHa represents the equivalent of the hydroxyl groups originating in (a) in the reaction of (a) and (b) and COOHb represents the equivalent of the carboxyl groups originating in (b) in the reaction of (a) and (b), and wherein the polyester resin (A) has an acid value of 13 to 50 mgKOH/g and a hydroxyl value of 8 mgKOH/g or less; and a toner composition including the same.

12 Claims, No Drawings

RESIN FOR TONER AND TONER COMPOSITION

CROSS-REFERENCE TO RELATED APPLICATIONS

This application is the 35 U.S.C. §371 national stage of PCT application PCT/JP2006/310531, filed May. 26, 2006, which claims priority to Japanese patent application No. 2005-155182, filed May. 27, 2005. The contents of these applications are incorporated herein by reference in their entirety.

TECHNICAL FIELD

The present invention relates to resins for toners and toner compositions to be used in electrophotography, electrostatic recording, electrostatic printing and so on.

BACKGROUND ART

Use of a polyester resin as a binder for improving the low-temperature fixing ability of a toner is known (see, for example, patent documents 1, 2). An approach of incorporating a crystalline resin is also proposed for improvement in low-temperature fixing ability (see, for example, patent documents 3).

Patent document 1: JP 62-78568 A
Patent document 2: JP 62-178278 A
Patent document 3: JP 2003-337443 A

DISCLOSURE OF THE INVENTION

Problem to Be Solved by the Invention

Reduction in molecular weight is needed in order to further improve the low-temperature fixing ability of a toner. In such cases, however, there is a problem that toners are somewhat poor in anti-blocking property at high temperature and high humidity. In addition, incorporation of a crystalline resin has a problem of affecting pulverisability.

Means for Solving the Problem

The inventors of the present invention studied assiduously to solve such problems and, as a result, have reached the invention.

That is, the invention provides: [1] a resin for toner, the resin comprising a polyester resin (A) produced by reacting a polyester resin (a) having an acid value of 6 mgKOH/g or less and a hydroxyl value of 10 to 80 mgKOH/g with at least one carboxylic acid (b) selected from the group consisting of aliphatic carboxylic acids, aromatic carboxylic acids, their anhydrides and lower alkyl (C1-C4) esters, wherein the equivalent ratio OHa/COOHb is 0.55 to 1.0 where OHa represents the equivalent of the hydroxyl groups originating in (a) in the reaction of (a) and (b) and COOHb represents the equivalent of the carboxyl groups originating in (b) in the reaction of (a) and (b), and wherein the polyester resin (A) has an acid value of 13 to 50 mgKOH/g and a hydroxyl value of 8 mgKOH/g or less; [2] a resin for toner, the resin comprising a polyester resin (A') which has an acid value of 13 to 50 mgKOH/g and a hydroxyl value of 8 mgKOH/g or less and has a THF-insoluble matter in a content of 1 to 50% by weight, wherein 30 to 100 mol % of the polyol component constituting the (A') is an aliphatic diol having 2 to 6 carbon atoms and the carboxylic acid component constituting the (A') comprises a trivalent or higher valent aromatic polycarboxylic acid; and [3] a toner composition comprising one of the above mentioned resins for toner, a colorant and, if necessary, one or more additives selected from mold release agents, charge control agents and fluidizing agents.

Effect of the Invention

By use of the resin for toner of the present invention, a toner with excellent low-temperature fixing ability can be obtained and the anti-blocking property of the toner is also good. Further, toners can be produced economically in industrial manufacture because the resin shows excellent pulverisability during the toner production.

BEST MODE FOR CARRYING OUT THE INVENTION

The invention will be described in detail.

The resin for toner of the present invention comprises a polyester resin (A) produced by reacting a polyester resin (a) having a specific acid value and a specific hydroxyl value with at least one carboxylic acid (b) selected from the group consisting of aliphatic carboxylic acids, aromatic carboxylic acids, their anhydrides and lower alkyl (C1-C4) esters.

As the polyester resin (a), preferred is a polyester resin obtained by polycondensing at least one polyol component with at least one polycarboxylic acid component.

It is preferred, in view of storage stability, that 30 to 100 mol %, more preferably 40 to 100 mol %, particularly preferably 50 to 100 mol %, and most preferably 80 to 100 mol % of the polyol component is an aliphatic diol having 2 to 6 carbon atoms. Because the polyester resin (A) is obtained by reacting a polyester resin (a) with a carboxylic acid (b), it is preferred that the polyol component constituting the (A) is also that mentioned above.

Examples of aliphatic diols having 2 to 6 carbon atoms include alkanediols such as ethylene glycol, 1,2-propylene glycol, 1,3-propylene glycol, 1,4-butanediol, 2,3-butanediol, 1,5-pentanediol, 2,3-pentanediol, 1,6-hexanediol, 2,3-hexanediol, 3,4-hexanediol and neopentyl glycol. Two or more species may be used in combination. Preferred among them are ethylene glycol, 1,2-propyleneglycol and neopentyl glycol. More preferred are ethylene glycol and 1,2-propylene glycol. Particularly preferred is 1,2-propylene glycol.

Examples of dihydric alcohol (diol) among polyol components other than aliphatic diols having 2 to 6 carbon atoms include aliphatic diols having 7 to 36 carbon atoms (1,7-heptanediol, dodecanediol, etc.); polyalkylene ether glycols having 4 to 36 carbon atoms (diethylene glycol, dipropylene glycol, polyethylene glycol, polypropylene glycol, etc.); adducts of aliphatic diols having 2 to 36 carbon atoms with alkylene oxides (herein after abbreviated as AO) having 2 to 4 carbon atoms [ethylene oxide (herein after abbreviated as EO), propylene oxide (herein after abbreviated as PO), butylene oxide, etc.] (additional molar number: 2 to 30); alicyclic diols having 6 to 36 carbon atoms (1,4-cyclohexanedimethanol, hydrogenated bisphenol A, etc.); adducts of the alicyclic diols with AOs having 2 to 4 carbon atoms (additional molar number: 2 to 30); and adducts of bisphenols (bisphenol A, bisphenol F, bisphenol S, etc.) with AOshaving2 to 4 carbon atoms (additional molar number: 2 to 30). Two or more species may also be used in combination.

Examples of tri- to octahydric or higher hydric polyols among polyol components include tri- to octahydric or higher hydric aliphatic polyols having 3 to 36 carbon atoms (glycerol, triethylolethane, trimethylolpropane, pentaerythritol, sorbitol, etc.); adducts of the alicyclic polyols with AOs having 2 to 4 carbon atoms (additional molar number: 2 to 30); adducts of trisphenols (trisphenol PA, etc.) with AOs having 2 to 4 carbon atoms (additional molar number: 2 to 30); and adducts of novolak resins (phenol novolak, cresol novolak, etc.; average degree of polymerization: 3 to 60) with AOs having 2 to 4 carbon atoms (additional molar number: 2 to 30). Two or more species may be used in combination.

Preferred among such polyol components other than aliphatic diols having 2 to 6 carbon atoms are polyalkylene ether glycols having 4 to 36 carbon atoms, alicyclic diols having 6 to 36 carbon atoms, adducts of alicyclic diols having 6 to 36 carbon atoms with AOs having 2 to 4 carbon atoms, adducts of bisphenols with AOs having 2 to 4 carbon atoms, and adducts of novolak resins with AOs having 2 to 4 carbon atoms. More preferred are adducts of bisphenols with AOs having 2 to 3 carbon atoms (EO and/or PO) and adducts of novolak resins with AOs having 2 to 3 carbon atoms (EO and/or PO).

Aliphatic dicarboxyli acids (including alicyclic ones) among polycarboxylic acid components may be alkanedicarboxylic acids having 2 to 50 carbon atoms (oxalic acid, malonic acid, succinic acid, adipic acid, lepargylic acid, sebasic acid, etc.); and alkenedicarboxylic acids having 4 to 50 carbon atoms (alkenylsuccinic acids such as dodecenylsuccinic acid, maleic acid, fumaric acid, citraconic acid, mesaconic acid, itaconic acid, glutaconic acid, etc.)

Aromatic dicarboxylic acids include, for example, aromatic dicarboxylic acids having 8 to 36 carbon atoms (phthalic acid, isophthalic acid, terephthalic acid, naphthalenedicarboxylic acid, etc.).

Tri- or hexavalent or higher valent aliphatic polycarboxylic acids (including alicyclic ones) include, for example, aliphatic tricarboxylic acids having 6 to 36 carbon atoms (hexane tricarboxylic acid, etc.), and vinyl polymers of unsaturated carboxylic acids [number average molecular weight (herein after referred to as Mn, determined by gel permeation chromatography (GPC)): 450 to 10000] ($\alpha$-olefin-maleic acid copolymers, etc.).

Among polycarboxylic acid components, tri- to hexavalent or higher valent aromatic polycarboxylic acids include, for example, aromatic polycarboxylic acids having 9 to 20 carbon atoms (trimellitic acid, pyromellitic acid, etc.); vinyl polymers of unsaturated carboxylic acids [Mn: 450 to 10000] (styrene/maleic acid copolymer, styrene/acrylic acid copolymer, styrene/fumaric acid copolymer, etc.).

As a polycarboxylic acid component, anhydrides and lower (C1-C4) alkylesters (methylester, ethylester, isopropylester, etc.) of those polycarboxylic acids may also be used.

Preferred among such polycarboxylic acid components are alkane dicarboxylic acids having 2 to 50 carbon atoms, alkene dicarboxylic acids having 4 to 50 carbon atoms, aromatic dicarboxylic acids having 8 to 20 carbon atoms, and aromatic polycarboxylic acids having 9 to 20 carbon atoms. More preferred are adipic acid, alkenylsuccinic acids having 16 to 50 carbon atoms, terephthalic acid, isophthalic acid, maleic acid, fumaric acid, trimellitic acid, pyromellitic acid, and their combinations. Particularly preferred are adipic acid, terephthalic acid, trimellitic acid, and their combinations. Anhydrides and lower alkyl esters of these acids are also preferred.

A preferred example of the polycarboxylic acid component is one comprising an aromatic polycarboxylic acid and an aliphatic polycarboxylic acid and containing the aromatic polycarboxylic acid in an amount of 60 mol % or more. The content of the aromatic polycarboxylic acid is more preferably 70 to 99 mol %, and most preferably 80 to 98 mol %. When an aromatic polycarboxylic acid is contained in an amount of 60 mol % or more, the resin strength increases and the low-temperature fixing ability is further improved.

In the present invention, the polyester resin (a) can be produced in a similar manner as the production method of conventional polyester. For example, it can be produced by carrying out a reaction under an inert gas atmosphere (nitrogen gas etc.), preferably at a reaction temperature of 150 to 280° C., more preferably. 160 to 250° C., and most preferably 170 to 235° C. From the viewpoint of certain execution of a polycondensation reaction, the reaction time is preferably not less than 30 minutes, and particularly preferably 2 to 40 hours.

At this time, an esterification catalyst may also be used according to demand. Examples of the esterification catalyst include tin-containing catalysts (e.g., dibutyltin oxide), antimony trioxide, titanium-containing catalysts [e.g., titanium alkoxides, potassium titanyl oxalate, titanium terephthalate, titanium terephthalate alkoxide, and dihydroxybis(triethanolaminato) titanium and its intramolecular polycondensates], zirconium-containing catalysts (e.g., zirconium acetate), and zinc acetate. To improve the reaction rate of the last reaction stage, reducing the pressure is also effective.

The polyol component-to-polycarboxylic acid component reaction ratio, as expressed in terms of hydroxyl group-to-carboxyl group equivalent ratio [OH]/[COOH], is preferably 1.5/1 to 1/1, more preferably 1.2/1 to 1/1, and most preferably 1.1/1 to 1/1. When some component is removed out of the system during the reaction, the above-mentioned reaction ratio is a ratio calculated by excluding the component.

The polyester resin (a) has an acid value of 6 (mgKOH/g, in which the following acid values are also expressed) or less and a hydroxyl value of 10 to 80 (mgKOH/g, in which the following hydroxyl values are also expressed). The acid value is preferably 5 or less, and more preferably 4 or less. The hydroxyl value is preferably 15 to 65, and more preferably 20 to 58. If the acid value is greater than 6, or if the hydroxyl value is greater than 80, this means that the polyester resin (a) has been polycondensed insufficiently and it is rich in low molecular weight components and thus the storage stability worsens. If the hydroxyl value is smaller than 10, the reaction efficiency with the carboxylic acid (b) worsens.

In order to make the acid value and the hydroxyl value of a polyester resin (a) within those ranges, it is effective to adjust the reaction ratio of the polyol component with the polycarboxylic acid component.

The acid value and the hydroxyl value of a polyester resin referred to in the above and subsequent descriptions are determined by the methods provided in JIS K 0070 (1992).

In addition, in the case where a sample contained a solvent-insoluble component caused by crosslinking, a sample after melt kneaded is used in the following method.

Kneading apparatus: Labo plastomill MODEL 30R150 manufactured by Toyo Seiki Seisaku-sho, Ltd.

Kneading conditions: at 130° C., 70 rpm for 30 minutes

Regarding the molecular weight of the polyester resin (a), the peak top molecular weight (herein after, Mp) is preferably 2000 to 10000. It is more preferable that the Mp is 2500 to 9000.

In the above and following descriptions, the molecular weights (Mp and Mn) of a polyester resin are determined using GPC under the following conditions.

Apparatus (example): HLC-8120, manufactured by Tosoh Corp.

Column (example): TSK GEL GMH6 (two columns), manufactured by Tosoh Corp.

Measuring temperature: 40° C.

Sample solution: 0.25% by weight THF solution

Solution injection amount: 100 μl

Detection apparatus: Refractive index detector

Reference material: Standard polystyrenes produced by Tosoh Corp. (TSK standard POLYSTYRENE) 12 points (Mw 1050, 2800, 5970, 9100, 18100, 37900, 96400, 190000, 355000, 1090000, 2890000 and 4480000)

The molecular weight corresponding to the maximum peak height on the chromatogram obtained is referred to as "peak top molecular weight (Mp)". In the measurement of the molecular weight of resin particles for toner, a solution prepared by picking up one arbitrary particle in a polyester resin for toner, dissolving it in THF and removing insoluble matters with a glass filter was used as a sample solution. This measurement was carried out for 10 particles.

The polyester resin (A) is obtained by causing a polyester resin (a) and a carboxylic acid (b) to react at a mixing ratio in the reaction expressed by an equivalent ratio OHa/COOHb of 0.55 to 1.0, where the equivalent of the hydroxyl groups originating in (a) is represented by OHa and the equivalent of the carboxyl groups originating in (b) is represented by COOHb. The OHa/COOHb is preferably 0.58 to 0.9, and more preferably 0.6 to 0.85. When the OHa/COOHb is less than 0.55, the molecular weight does not increase sufficiently and, therefore, the hot offset resistance of the toner compounding therefrom will deteriorate. When the ratio is greater than 1.0, the fluidity of the resin is reduced and, as a result, the low-temperature fixing ability of the toner compounding therefrom will deteriorate.

As the carboxylic acid (b), any one or both a monocarboxylic acid and a polycarboxylic acid may be used. Regarding the ratio of the monocarboxylic acid to the polycarboxylic acid, the equivalent ratio of the carboxyl groups originating in the monocarboxylic acid to the carboxyl groups originating in the polycarboxylic acid is preferably (0-50)/(50-100), and more preferably (0-20)/(80-100), where the equivalence of all the carboxyl groups in the carboxylic acids used in the reaction is considered to be 100. When the ratio of the carboxyl groups originating in the monocarboxylic acid is 50 or less, crosslinking does not occur insufficiently and the resin will become strong enough. Further, it is easy to adjust the acid value of a reaction product in a predetermined range easily.

As the carboxylic acid component, acid anhydrides and lower (C1-C4) alkylesters (methylester, ethylester, isopropyl ester, etc.) may also be used.

Among the monocarboxylic acids to be used as the carboxylic acid (b), examples of aliphatic (including alicyclic) monocarboxylic acids include alkane monocarboxylic acids having 1 to 50 carbon atoms (formic acid, acetic acid, propionic acid, butanoic acid, isobutanoic acid, caprylic acid, capric acid, lauric acid, myristylic acid, palmitic acid, stearic acid, etc.), and alkene monocarboxylic acids having 3 to 50 carbon atoms (acrylic acid, methacrylic acid, oleic acid, linoleic acid, etc.).

The aromatic monocarboxylic acids include, for example, aromatic monocarboxylic acids having 7 to 36 carbon atoms (benzoic acid, methylbenzoic acid, phenylpropionic acid, naphthoic acid, etc.).

Among the polycarboxylic acids to be used as (b), examples of aliphatic (including alicyclic) dicarboxylic acid, aromatic dicarboxylic acids, tri-to hexavalent or higher valent aliphatic (including alicyclic) polycarboxylic acids, and tri-to hexavalent or higher valent aromatic polycarboxylic acids may be the same as those used in the polyester resin (a).

Preferred among these are divalent or higher valent aromatic carboxylic acids. More preferred are tri- to hexavalent or higher valent aromatic polycarboxylic acids. Particularly preferred are trimellitic acid and trimellitic anhydride.

The polyester resin (A) can be obtained in the same production method as the polyester resin (a) except for adjusting the product to have an acid value and a hydroxyl value in the ranges given below.

The acid value of (A) is 13 to 50, and preferably 15 to 40. The hydroxyl value is 8 or less, and preferably not more than 6.

If the acid value is less than 13, the fixing strength becomes weak. If the hydroxyl value exceeds 8 or if the acid value exceeds 50, the product becomes susceptible to environmental conditions and the stability is deteriorated.

The THF-insoluble matter content of the polyester resin (A) is preferably 1 to 50% by weight, and more preferably 2 to 35% by weight. If the THF-insoluble matter content is 1% by weight or more, good hot offset resistance is obtained and, if it is 50% by weight or less, the low-temperature fixing ability is good.

In the above and the following descriptions, a THF-insoluble matter content of a polyester resin is determined by the following method.

50 ml of THF was added to 0.5 g of a sample, and subjected to agitation under refluxing for three hours. After cooling, an insoluble component was filtered by a glass filter and the resin component remaining on the glass filter is subjected to drying under reduced pressure at 80° C. for three hours. An insoluble matter content is calculated from the ratio of the weight of the dried resin component on the glass filter and the weight of the sample used.

Regarding the molecular weight of the polyester resin (A), Mp is preferably 4500 to 15000, and more preferably 5000 to 12000. Among polyester resins obtain able by a production method the same that of the resin of the first invention, a polyester resin (A') which has an acid value of 13 to 50 mgKOH/g and a hydroxyl value of 8 mgKOH/g or less and has a THF-insoluble matter in a content of 1 to 50% by weight, wherein 30 to 100 mol % (preferably, 80 to 100 mol %) of the polyol component constituting it is an aliphatic diol having 2 to 6 carbon atoms (preferably, 1,2-propylene glycol) and the carboxylic acid component constituting it comprises a trivalent or higher valent aromatic polycarboxylic acid is particularly suitable as a resin for toner (second invention) because the trivalent or higher valent aromatic carboxylic acid serves as a crosslinking agent to produce a sufficient resin strength.

The content of the trivalent or higher valent aromatic polycarboxylic acid in the carboxylic acid component is preferably 1 to 30 mol %, and more preferably 2 to 20 mol %. When the content is 30 mol % or less, the fluidity of the resin is good and, as a result, the low-temperature fixing ability of the toner compounding therefrom will be improved.

The composition and preferable substances of the raw materials for constituting the polyester resin (A'), the molecular weight of (A'), and the preferable ranges of the acid value, hydroxyl value and THF-insoluble matter content of (A') are the same as those of the polyester resin (A).

The resin for toner of the present invention may contain, together with the polyester resin (A), a polyester resin (B) other than the (A) which is free from any THF-insoluble matter. The term "polyester resin (A)" is hereafter used in a meaning encompassing the polyester resin (A').

The polyester resin (B) is typically obtained by polycondensing at least one polyol component with at least one polycarboxylic acid component.

Diols among the polyol components include, for example, aliphatic diols having 2 to 6 carbon atoms, aliphatic diols having 7 to 36 carbon atoms, polyalkylene ether glycols having 4 to 36 carbon atoms, adducts of aliphatic diols having 2 to 36 carbon atoms with AOs having 2 to 4 carbon atoms (addition molar number: 2 to 30); alicyclic diols having 6 to 36 carbon atoms, adducts of alicyclic diols having 6 to 36 carbon atoms with AOs having 2 to 4 carbon atoms (addition molar number: 2 to 30); and adducts of bisphenols with AOs having 2 to 4 carbon atoms (addition molar number: 2 to 30). Two or more species may be used in combination. Specific examples of these materials may be the same as those to be use for the above-mentioned polyester resin (a).

Tri- to octahydric or higher hydric alcohols among the polyol components include, for example, tri- to octahydric or higher hydric aliphatic polyols having 3 to 36 carbon atoms, adducts of aliphatic polyols with AOs having 2 to 4 carbon atoms (addition molar number: 2 to 30); adducts of trisphenols with AOs having 2 to 4 carbon atoms (addition molar number: 2 to 30); and adducts of novolak resins with AOs having 2 to 4 carbon atoms (addition molar number: 2 to 30). Two or more species may be used in combination. Specific examples of these materials may be the same as those to be use for the above-mentioned polyester resin (a).

Preferred among such polyol components are aliphatic diols having 2 to 6 carbon atoms, polyalkylene ether glycols having 4 to 36 carbon atoms, alicyclic diols having 6 to 36 carbon atoms, adducts of alicyclic diols having 6 to 36 carbon atoms with AOs having 2 to 4 carbon atoms, adducts of bisphenols with AOs having 2 to 4 carbon atoms, and adducts of novolak resins with AOs having 2 to 4 carbon atoms. More preferred are aliphatic diols having 2 to 6 carbon atoms, adducts of bisphenols with AOs having 2 to 3 carbon atoms (EO and PO) and adducts of novolak resins with AOs having 2 to 3 carbon atoms (EO and PO).

Among the polycarboxylic acid components, examples of aliphatic (including alicyclic) dicarboxylic acids, aromatic dicarboxylic acids, tri- to hexavalent or higher valent aliphatic (including alicyclic) polycarboxylic acids, and tri- to hexavalent or higher valent aromatic polycarboxylic acids may be the same as those used in the polyester resin (a).

As the polycarboxylic acid component, anhydrides and lower (C1-C4) alkyl esters of these polycarboxylic acids may be used.

Preferred among these polycarboxylic acids are the same as those of the polycarboxylic acid to be used in the polyester resin (a).

The acid value of the polyester resin (B) is preferably 2 to 80, more preferably 5 to 50, and particularly preferably 10 to 30.

The hydroxyl value is preferably 60 or less, more preferably 50 or less, and particularly preferably 5 to 45.

Regarding the molecular weight of the polyester resin (B), Mp is preferably 3000 to 10000, and more preferably 3500 to 9000.

The polyester resin (B) in the present invention can be produced in a similar manner to the production method of conventional polyester. For example, the same method as the production method of the above-mentioned polyester resin (a) can be used.

The polyol component-to-polycarboxylic acid component reaction ratio, as expressed in terms of hydroxyl group-to-carboxyl group equivalent ratio [OH]/[COOH], is preferably 2/1 to 1/2, more preferably 1.5/1 to 1/1.3, and particularly preferably 1.3/1 to 1/1.2.

The resin for toner of the present invention shows excellent fixing ability even when it is composed solely of a polyester resin (A), but when it contains a polyester (B) together with the polyester resin (A), further improved fixing ability is obtained. The weight ratio of (A) to (B) is preferably (20 to 100)/(0 to 80), more preferably (30 to 99)/(1 to 70), and particularly preferably (40 to 90)/(10 to 60) where the sum total of (A) and (B) is considered to be 100. When the ratio of the polyester resin (A) is 20 or more, the strength of the resin increases and the fixing ability in a high temperature region is good.

The resin for toner of the present invention is preferably composed solely of a polyester resin (A) or only a polyester resin (A) and polyester resin (B). It, however, may contain another resin unless the characteristic properties of the resin for toner of the present invention are spoiled. The other resin includes, for example, polyester resins other than (A) and (B), vinyl resins [e.g. styrene-alkyl (meth)acrylate copolymers, styrene-diene monomer copolymers], epoxy resins (e.g. ring opening polymerization products of bisphenol A diglycidyl ether, etc.), and urethane resins (e.g. polyaddition products of diol and/or trihydric or higher hydric polyol and diisocyanate, etc.). The Mn of the other resin is preferably 1000 to 1,000,000. The content of the other resin is preferably not more than 10% by weight, and more preferably not more than 5% by weight.

In use of two or more polyester resins combinedly, and in mixing at least one polyester resin with another resin, they may be subjected to powder mixing or melt mixing beforehand or may be mixed at the time of toner compounding.

The temperature in the melt mixing is preferably 80 to 180° C., more preferably 100 to 170° C., and particularly preferably 120 to 160° C.

If the mixing temperature is too low, mixing cannot be accomplished satisfactorily and the system may become inhomogeneous. When the mixing temperature in mixing two or more polyester resins together is excessively high, averaging due to transesterification and other reactions may occur, and it may thus become impossible to maintain those resin properties which are required of toner binders.

The mixing time in melt mixing is preferably 10 seconds to 30 minutes, more preferably 20 seconds to 10 minutes, and particularly preferably 30 seconds to 5 minutes. When the mixing time in mixing two or more polyester resins together is excessively long, averaging due to transesterification and other reactions may occur, and it may thus become impossible to maintain those resin properties which are required of toner binders.

The mixing apparatus for melt mixing includes, for example, batch type mixing apparatus, such as reaction vessels, and continuous mixing apparatus. For attaining uniform mixing at an adequate temperature for a short period of time, a continuous mixing apparatus is preferred. As continuous mixing apparatuses, there are listed extruders, continuous kneaders, three-roll mills and so on. Among them, extruders and continuous kneaders are preferred.

In the case of powder mixing, mixing can be attained using conventional mixing conditions and a conventional mixing apparatus.

Regarding the mixing conditions in powder mixing, the mixing temperature is preferably 0 to 80° C., and more preferably 10 to 60° C. The mixing time is preferably not shorter than 3 minutes, and more preferably 5 to 60 minutes.

The mixing apparatus includes, for example, Henschel mixers, Nauta mixers, and Banbury mixers. Henschel mixers are preferred.

The toner composition of the present invention comprises the resin for toner of the present invention, which serves as a binder resin, a colorant and, according to need, at least one additive selected from mold release agents, charge control agents and fluidizing agents.

As the colorant, any dye, pigment and the like which have been used as a colorant for toner can be used. Specific examples include carbon black, iron black, sudan black SM, fast yellow G, benzidine yellow, pigment yellow, indofast orange, Irgasine red, paranitroaniline red, toluidine red, carmine FB, pigment orange R, lake red 2G, rhodamine FB, rhodamine B lake, methyl violet Blake, phthalocyanine blue, pigment blue, brilliant green, phthalocyanine green, oil yellow GG, Kayaset YG, olasol brown B and oil pink OP. These may be used singly or in combination of two or more of them. According to need, a magnetic powder (a ferromagnetic metal powder such as iron, cobalt and nickel or a compound such as magnetite, hematite and ferrite) may be contained to serve also as a function as a colorant. The content of the colorant is preferably 1 to 40 parts, and more preferably 3 to 10 parts, based on 100 parts of the polyester resin of the present invention. In use of a magnetic powder, the amount thereof is preferably 20 to 150 parts, and more preferably 40 to 120 parts. In the above and following descriptions, "part" means "part by weight".

As the mold release agent, one having a softening point of 50 to 170° C. is preferred. Example thereof includes polyolefin wax, natural wax, aliphatic alcohols having 30 to 50 carbon atoms, fatty acids having 30 to 50 carbon atoms, and their mixtures. Examples of polyolefin wax include (co)polymers of olefins (e.g. ethylene, propylene, 1-butene, isobutylene, 1-hexene, 1-dodecene, 1-octadecene and their mixtures) [including products obtained by (co)polymerization and thermally degraded polyolefin], oxides of olefins (co)polymers prepared by use of oxygen and/or ozone, maleic acid-modified olefin (co)polymers [e.g. products modified with maleic acid or its derivative (maleic anhydride, monomethyl maleate, monobutyl maleate and dimethyl maleate)], copolymers of olefin and unsaturated carboxylic acid [(meth)acrylic acid, itaconic acid, maleic anhydride, etc.] and/or alkyl unsaturated carboxylates [alkyl (meth)acrylates (1 to 18 carbon atoms in the alkyl), alkyl maleates (1 to 18 carbon atoms in the alkyl), etc.], and Sasol wax.

The natural wax includes, for example, carnauba wax, montan wax, paraffin wax and rice wax. An example of the aliphatic alcohols having 30 to 50 carbon atoms is triacontanol. An example of the fatty acids having 30 to 50 carbon atoms is triacontan carboxylic acid.

Examples of the charge control agent include nigrosine dyes, triphenylmethane-based dyes containing a tertiary amine as a side chain, quaternary ammonium salts, polyamine resins, imidazole derivatives, quaternary ammonium salt-containing polymers, metal-containing azo dyes, copper phthalocyanine dyes, metal salts of salicylic acid, boron complexes of benzilic acid, sulfonic acid group-containing polymers, fluorine-containing polymers and halogen-substituted aromatic ring-containing polymers.

The fluidizing agent includes, for examples, colloidal silica, alumina powder, titanium oxide powder and calcium carbonate powder.

Regarding the compositional ratio of the toner composition of the present invention, based on the weight of the toner, the resin for toner of the present invention is preferably 30 to 97% by weight, more preferably 40 to 95% by weight, and particularly preferably 45 to 92% by weight; the colorant is preferably 0.05 to 60% by weight, more preferably 0.1 to 55% by weight, and particularly preferably 0.5 to 50% by weight; among additives, the mold release agent is preferably 0 to 30% by weight, more preferably 0.5 to 20% by weight, and particularly preferably 1 to 10% by weight; the charge control agent is preferably 0 to 20% by weight, more preferably 0.1 to 10% by weight, and particularly preferably 0.5 to 7.5% by weight; and the fluidizing agent is preferably 0 to 10% by weight, more preferably 0 to 5% by weight, and particularly preferably 0.1 to 4% by weight. The total content of the additives is preferably 3 to 70% by weight, more preferably 4 to 58% by weight, and particularly preferably 5 to 50% by weight. When the compositional ratio of the toner falls within the above-mentioned range, a toner with good electrostatic property can be easily obtained.

The toner composition of the present invention may be prepared by any of conventionally known methods such as a kneading-pulverization method, an emulsion phase-inversion method and a polymerization method. For example, in obtaining of a toner by kneading-pulverization method, it can be prepared by dry blending its components other than a fluidizing agent which are to constitute the toner, melt-kneading, then coarsely pulverizing, finally finely pulverizing using a jet mill pulverizer or the like, further classifying to form fine particles preferably having a volume average particle diameter (D50) of 5 to 20 μm, and then mixing a fluidizing agent. The particle diameter D50 is determined using a Coulter counter [e.g. commercial name: Multisizer III (product of Coulter)].

In preparation of a toner by emulsion phase-inversion method, it can be prepared by dissolving or dispersing in an organic solvent the components other than a fluidizing agent which are to constitute the toner, emulsifying them, for example, by addition of water, and then conducting separation and classification. The volume average particle diameter of the toner is preferably 3 to 15 μm.

The toner composition of the present invention is mixed with carrier particles, such as iron powder, glass beads, nickel powder, ferrite, magnetite, ferrite whose surfaces are coated with a resin (acrylic resin, silicone resin, etc.), depending upon needs, to be used as developer for developing electric latent images.

The weight ratio of toner to carrier particles is usually 1/99 to 100/0. It is also possible to form electric latent images by friction with such a member as a charging blade in lieu of the use of carrier particles.

The toner composition of the present invention is then fixed to a support (e.g. paper and polyester film) by use of a copier, a printer or the like to form a recording material. As a fixing method to a support, conventional heat roll fixing method and flash fixing method, etc. can be used.

EXAMPLES

Hereinbelow, the present invention will be further described with reference to Examples, by which the present invention is not limited.

A method of measuring properties of polyester resins for toner obtained in examples and comparative examples will be shown in the following.

1. Acid Value and Hydroxyl Value

Method Prescribed in JIS K0070 (1992)

In addition, in the case where a sample contained a solvent-insoluble component caused by crosslinking, a sample after melt kneaded in molten state was used in the following method.

Kneading apparatus: Labo plastomill MODEL 4M150 manufactured by Toyo Seiki Seisaku-sho, Ltd.

Kneading conditions: at 130° C., 70 rpm for 30 minutes

2. Measurement of Softening Point

A flow tester was used to raise temperature in uniform velocity under the following condition, and a softening point was given by temperature when an amount of the resin outflow reached 1/2.

Apparatus: Flow Tester CFT-500 manufactured by Shimadzu Corp.

Load: 20 kg

Die: 1 mmϕ-1 mm

Rate of temperature rise: 6° C./min

Example 1

A reaction vessel equipped with a condenser, a stirrer and a nitrogen inlet tube was charged with 950 parts (12.5 mol) of 1,2-propylene glycol (herein after, referred to as propylene glycol), 922 parts (4.8 mol) of dimethyl terephthalate, 37 parts (0.25 mol) of adipic acid and 3 parts of tetrabutoxytitanate as a condensation catalyst, and then a reaction was carried out under a nitrogen stream at 180° C. for 8 hours while methanol produced was distilled off. Subsequently, during a slow increase of the temperature to 230° C., the reaction was carried out under a nitrogen stream for 4 hours while propylene glycol and water produced were distilled off. Thereafter, a further reaction was carried out under a vacuum of 5 to 20 mmHg and the product was taken out when its softening point reached 85° C. The amount of the propylene glycol collected was 521 parts (6.9 mol). The resin taken out was cooled to room temperature and then pulverized to form particles. This is called polyester resin (a1). Polyester resin (a1) had an acid value of 2, a hydroxyl value of 57, an Mn of 2000, and an Mp of 3500.

A reaction vessel equipped with a condenser, a stirrer and a nitrogen inlet tube was charged with 500 parts of polyester resin (a1), 40 parts (0.21 mol) of trimellitic anhydride, and 3 parts of tetrabutoxytitanate as a condensation catalyst. After replacing of the vapor phase in the system by nitrogen, a reaction was carried out at 180° C. under ordinary pressure for 2 hours in a hermetic condition. Thereafter, a further reaction was carried out at 220° C. and a vacuum of 5 to 20 mmHg, and the product was taken out when its softening point reached 180° C. The product was cooled to room temperature and then pulverized to form particles. In the reaction, OHa/COOHb was 0.81. The product is called polyester resin (A1).

Polyester resin (A1) had an acid value of 17, a hydroxyl value of 2, an Mn of 5200, an Mp of 9400, and a THF-insoluble matter content of 34% by weight.

A reaction vessel equipped with a condenser, a stirrer and a nitrogen inlet tube was charged with 379 parts (1.2 mol) of bisphenol A-EO (2 mol) adduct, 447 parts (1.3 mol) of bisphenol A-PO (2 mol) adduct, 332 parts (2.0 mol) of terephthalic acid and 3 parts of tetrabutoxytitanate as a condensation catalyst, and a reaction was carried out under a nitrogen stream at 230° C. for 5 hours while water produced was distilled off. Subsequently, a further reaction was carried out under a vacuum of 5 to 20 mmHg, followed by cooling to 180° C. when the acid value became 2 or less. Then, 40 parts (0.21 mol) of trimellitic anhydride was added and a reaction was carried out under ordinary pressure for 2 hours in a hermetic condition. The product was taken out, cooled to room temperature and then pulverized to form particles. The product is called polyester resin (B1).

Polyester resin (B1) had an acid value of 21, a hydroxyl value of 37, an Mn of 2000, an Mp of 4200, and a THF-insoluble matter content of 0% by weight.

500 parts of polyester resin (A1) and 500 parts of polyester resin (B1) were melt kneaded in a continuous kneader at a jacket temperature of 150° C. and a residence time of 3 minutes. The melted resin was cooled to room temperature and then pulverized by a pulverizer to provide particles. Thus, resin (1) for toner of the present invention was obtained.

Example 2

A reaction vessel equipped with a condenser, a stirrer and a nitrogen inlet tube was charged with 500 parts of polyester resin (a1) obtained in Example 1, 50 parts (0.26 mol) of trimellitic anhydride, and 3 parts of tetrabutoxytitanate as a condensation catalyst. After replacing of the vapor phase in the system by nitrogen, a reaction was carried out at 180° C. under ordinary pressure for 2 hours in a hermetic condition. Thereafter, a further reaction was carried out at 220° C. and a vacuum of 5 to 20 mmHg, and the product was taken out when its softening point reached 160° C. The product was cooled to room temperature and then pulverized to form particles. In the reaction, OHa/COOHb was 0.65. The product is called polyester resin (A2).

Polyester resin (A2) had an acid value of 27, a hydroxyl value of 1, an Mn of 4500, an Mp of 8000, and a THF-insoluble matter content of 20% by weight.

500 parts of polyester resin (A2) and 500 parts of polyester resin (B1) given in Example 1 were melt mixed in a continuous kneader at a jacket temperature of 150° C. and a residence time of 3 minutes. The melted resin was cooled to room temperature and then pulverized by a pulverizer to provide particles. Thus, resin (2) for toner of the present invention was obtained.

Example 3

A reaction vessel equipped with a condenser, a stirrer and a nitrogen inlet tube was charged with 950 parts (12.5 mol) of propylene glycol, 158 parts (0.5 mol) of bisphenol A-EO (2 mol) adduct, 824.5 parts (4.3 mol) of dimethyl terephthalate, 109.5 parts (0.75 mol) of adipic acid and 3 parts of tetrabutoxytitanate as a condensation catalyst, and then a reaction was carried out under a nitrogen stream at 180° C. for 8 hours while methanol produced was distilled off. Subsequently, during a slow increase of the temperature to 230° C., the reaction was carried out under a nitrogen stream for 4 hours while propylene glycol and water produced were distilled off. Thereafter, a further reaction was carried out under a vacuum of 5 to 20 mmHg and the product was taken out when its softening point reached 85° C. The amount of the propylene glycol collected was 577.6 parts (7.6 mol). The resin taken out was cooled to room temperature and then pulverized to form particles. This is called polyester resin (a2).

Polyester resin (a2) had an acid value of 1, a hydroxyl value of 34, an Mn of 3000, and an Mp of 6100.

A reaction vessel equipped with a condenser, a stirrer and a nitrogen inlet tube was charged with 500 parts of polyester resin (a2), 30 parts (0.16 mol) of trimellitic anhydride, and 3 parts of tetrabutoxytitanate as a condensation catalyst. After replacing of the vapor phase in the system by nitrogen, a reaction was carried out at 180° C. under ordinary pressure for 2 hours in a hermetic condition. Thereafter, a further reaction was carried out at 220° C. and a vacuum of 5 to 20 mmHg, and the product was taken out when its softening point reached 170° C. The product was cooled to room temperature and then pulverized to form particles. In the reaction, OHa/COOHb was 0.65. The product is called polyester resin (A3).

Polyester resin (A3) had an acid value of 18, a hydroxyl value of 2, an Mn of 5000, an Mp of 8700, and a THF-insoluble matter content of 28% by weight.

500 parts of polyester resin (A3) and 500 parts of polyester resin (B1) given in Example 1 were melt mixed in a continuous kneader at a jacket temperature of 150° C. and a residence time of 3 minutes. The melted resin was cooled to room temperature and then pulverized by a pulverizer to provide particles. Thus, resin (3) for toner of the present invention was obtained.

Example 4

A pressurizable reaction vessel equipped with a condenser, a stirrer and a nitrogen inlet tube was charged with 1064 parts (14.0 mol) of propylene glycol, 498 parts (3.0 mol) of terephthalic acid, 29 parts (0.2 mol) of adipic acid, and 3 parts of tetrabutoxytitanate as a condensation catalyst. After replacing of the vapor phase in the system by nitrogen, the temperature was increased to 150° C. and then the inside of the system was pressurized with nitrogen to 0.3 MPa. A reaction was carried out at 230° C. for 8 hours while water and propylene glycol produced were distilled off. Then, the pressure in the system was returned to ordinary pressure. Subsequently, a further reaction was carried out at 230° C. while propylene glycol and water produced were distilled off under a vacuum of 5 to 20 mmHg. The product was taken out when its softening point reached 90° C. The amount of the propylene glycol collected was 798 parts (10.5 mol). The resin taken out was cooled to room temperature and then pulverized to form particles. This is called polyester resin (a3).

Polyester resin (a3) had an acid value of 1, a hydroxyl value of 45, an Mn of 2200, and an Mp of 4800.

A reaction vessel equipped with a condenser, a stirrer and a nitrogen inlet tube was charged with 500 parts of polyester resin (a3), 40 parts (0.21 mol) of trimellitic anhydride, and 3 parts of tetrabutoxytitanate as a condensation catalyst. After replacing of the vapor phase in the system by nitrogen, a reaction was carried out at 180° C. under ordinary pressure for 2 hours in a hermetic condition. Thereafter, a further reaction was carried out at 220° C. and a vacuum of 5 to 20 mmHg, and the product was taken out when its softening point reached 170° C. The product was cooled to room temperature and then pulverized to form particles. In the reaction, OHa/COOHb was 0.64. The product is called polyester resin (A4).

Polyester resin (A4) had an acid value of 25, a hydroxyl value of 2, an Mn of 5200, an Mp of 8900, and a THF-insoluble matter content of 24% by weight.

500 parts of polyester resin (A4) and 500 parts of polyester resin (B1) given in Example 1 were melt mixed in a continuous kneader at a jacket temperature of 150° C. and a residence time of 3 minutes. The melted resin was cooled to room temperature and then pulverized by a pulverizer to provide particles. Thus, resin (4) for toner of the present invention was obtained.

Example 5

The polyester resin (A2) of Example 2 was used as resin (5) for toner of the present invention.

Comparative Example 1

A reaction vessel equipped with a condenser, a stirrer and a nitrogen inlet tube was charged with 500 parts of polyester resin (a1) given in Example 1, 70 parts (0.36 mol) of trimellitic anhydride, and 3 parts of tetrabutoxytitanate as a condensation catalyst. After replacing of the vapor phase in the system by nitrogen, a reaction was carried out at 180° C. under ordinary pressure for 2 hours in a hermetic condition. Thereafter, a further reaction was carried out at 220° C. and a vacuum of 5 to 20 mmHg, but the softening point did not reached 110° C. or higher. Therefore, the product was taken out, cooled to room temperature and then pulverized to form particles.

In the reaction, OHa/COOHb was 0.46. The product is called polyester resin (C1).

Polyester resin (C1) had an acid value of 55, a hydroxyl value of 1, an Mn of 2800, an Mp of 3500, and a THF-insoluble matter content of 0% by weight.

500 parts of polyester resin (C1) and 500 parts of polyester resin (B1) given in Example 1 were melt mixed in a continuous kneader at a jacket temperature of 150° C. and a residence time of 3 minutes. The melted resin was cooled to room temperature and then pulverized by a pulverizer to provide particles. Thus, resin (6) for toner for comparison use was obtained.

Comparative Example 2

A reaction vessel equipped with a condenser, a stirrer and a nitrogen inlet tube was charged with 500 parts of polyester resin (a1) given in Example 1, 30 parts (0.16 mol) of trimellitic anhydride, and 3 parts of tetrabutoxytitanate as a condensation catalyst. After replacing of the vapor phase in the system by nitrogen, a reaction was carried out at 180° C. under ordinary pressure for 2 hours in a hermetic condition. Thereafter, a further reaction was carried out at 220° C. and a vacuum of 5 to 20 mmHg, and the product was taken out when its softening point reached 180° C. The product was cooled to room temperature and then pulverized to form particles. In the reaction, OHa/COOHb was 1.08. The product is called polyester resin (C2).

Polyester resin (C2) had an acid value of 4, a hydroxyl value of 4, an Mn of 4400, an Mp of 7500, and a THF-insoluble matter content of 41% by weight.

500 parts of polyester resin (C2) and 500 parts of polyester resin (B1) given in Example 1 were melt mixed in a continuous kneader at a jacket temperature of 150° C. and a residence time of 3 minutes. The melted resin was cooled to room temperature and then pulverized by a pulverizer to provide particles. Thus, resin (7) for toner for comparison use was obtained.

Comparative Example 3

A pressurizable reaction vessel equipped with a condenser, a stirrer and a nitrogen inlet tube was charged with 1292 parts (17.0 mol) of propylene glycol, 714 parts (4.3 mol) of terephthalic acid, 44 parts (0.3 mol) of adipic acid, and 3 parts of tetrabutoxytitanate as a condensation catalyst. After replacing of the vapor phase in the system by nitrogen, the temperature was increased to 150° C. and then the inside of the system was pressurized with nitrogen to 0.3 MPa. A reaction was carried out at 230° C. for 4 hours while water and propylene glycol produced were distilled off. Then, the pressure in the system was returned to ordinary pressure. Subsequently, a further reaction was carried out at 230° C. while propylene glycol and water produced were distilled off under a vacuum of 5 to 20 mmHg. The product was taken out when its softening point reached 80° C. The amount of the propylene glycol collected was 876 parts (11.5 mol). The resin taken out was cooled to room temperature and then pulverized to form particles.

This is called polyester resin (a'1).

Polyester resin (a'1) had an acid value of 1, a hydroxyl value of 93, an Mn of 1200, and an Mp of 2500.

A reaction vessel equipped with a condenser, a stirrer and a nitrogen inlet tube was charged with 500 parts of polyester resin (a'1), 70 parts (0.36 mol) of trimellitic anhydride, and 3 parts of tetrabutoxytitanate as a condensation catalyst. After replacing of the vapor phase in the system by nitrogen, a reaction was carried out at 180° C. under ordinary pressure for 2 hours in a hermetic condition. Thereafter, a further reaction was carried out at 220° C. and a vacuum of 5 to 20 mmHg, and the product was taken out when its softening point reached 145° C. The product was cooled to room temperature and then pulverized to form particles. In the reaction, OHa/COOHb was 0.75. The product is called polyester resin (C3).

Polyester resin (C3) had an acid value of 33, a hydroxyl value of 9, an Mn of 2300, an Mp of 4100, and a THF-insoluble matter content of 49% by weight.

500 parts of polyester resin (C3) and 500 parts of polyester resin (B1) given in Example 1 were melt mixed in a continuous kneader at a jacket temperature of 150° C. and a residence time of 3 minutes. The melted resin was cooled to room temperature and then pulverized by a pulverizer to provide particles. Thus, resin (8) for toner for comparison use was obtained.

Examples [6-10], Comparative Examples [4-6]

To each of resins (1) to (5) for toner of the present invention and resins (6) to (8) for toner for comparison use in an amount of 100 parts, 8 parts of carbon black MA-100 (manufactured by Mitsubishi Chemical Co., Inc.), 5 parts of carnauba wax and 1 part of charge control agent T-77 (manufactured by Hodogaya Chemical Co., Ltd.) were added, followed by toner compounding in the following procedures.

Premixing was carried out using a Henschel mixer (FM10B, manufactured by Mitsui Miike Kakoki) and then kneading was carried out using a twin-screw kneader (PCM-30, manufactured by Ikegai Corporation). The mixture was then finely pulverized using a supersonic jet pulverizer [Labojet, product of Nippon Pneumatic Mfg. Co.], followed by classification using an air classifier [model MDS-I, product of Nippon Pneumatic Mfg. Co.] to give toner particles with a particle diameter D50 of 8 μm. Subsequently, 0.5 parts of colloidal silica (aerosil R972: manufactured by Nippon Aerosil Co., Ltd.) was mixed with 100 parts of toner particles using a sample mill to provide toner compositions (T1) to (T5) of the present invention and comparative toner compositions (T6) to (T8).

The results of evaluations made by the following evaluation methods are shown in Table 1.

TABLE 1

| Toner No. | MFT (° C.) | HOT (° C.) | Anti-blocking property | Pulverisability μm |
|---|---|---|---|---|
| Toner composition (T1) | 125 | 230 | ⊙ | 12 |
| Toner composition (T2) | 120 | 230 | ⊙ | 11 |
| Toner composition (T3) | 120 | 230 | ⊙ | 12 |
| Toner composition (T4) | 125 | 230 | ⊙ | 12 |

TABLE 1-continued

| Toner No. | MFT (° C.) | HOT (° C.) | Anti-blocking property | Pulverisability μm |
|---|---|---|---|---|
| Toner composition (T5) | 120 | 230 | ⊙ | 11 |
| Comparative toner composition (T6) | 120 | 190 | Δ | 11 |
| Comparative toner composition (T7) | 135 | 230 | ⊙ | 15 |
| Comparative toner composition (T8) | 140 | 220 | ○ | 13 |

[Method of Evaluation]

[1] Minimum Fixing Temperature (MFT)

A fixing device of a commercially available copier (AR5030: manufactured by Sharp Corporation) was used to evaluate a non-fixing image developed by the copier. A fixing roll temperature, at which a image density remaining percentage after rubbing of a fixed image by a pad became at least 70%, was made a minimum fixing temperature.

[2] Hot Offset Occurrence Temperature (HOT)

Like the above MFT, evaluation of fixing was made, and the existence of hot offset on a fixed image was evaluated visually. A fixing roll temperature, at which hot offset was occurred, was made an hot offset occurrence temperature.

[3] Test of Toner's Anti-blocking Property

Each of the toner compositions was conditioned in a high-temperature and high-humidity environment (50° C., 85% R.H.) for 48 hours. Under the same environment the blocking state of each developer was visually judged, and the image quality of a copy produced by use of a commercially available copier (AR5030; produced by Sharp Corp.) was also observed.

Criterion

⊙: No blocking of the toner is recognized and image quality after 3000-sheet copying is good.

○: No blocking of the toner is recognized, but slight disorder in image quality after 3000-sheet copying is recognized.

Δ: Blocking of the toner is visually recognized and disorder in image quality after 3000-sheet copying is recognized.

x: Blocking of the toner is visually recognized and images are no longer formed before 3000-sheet copying.

[4] Pulverisability

A coarsely ground toner which had been kneaded in a twin-screw kneader and cooled, which could pass through 8.6 mesh but remain on 30 mesh, was finely pulverized using a supersonic jet pulverizer "Labojet", product of Nippon Pneumatic Mfg. Co.

Pulverising pressure: 0.5 MPa

Adjuster ring: 15 mm

Size of a louver: medium

Pulverising time: 10 minutes

The resultant was subjected, without classification, to volume average particle diameter measurement using a Coulter counter TAII (produced by Coulter Electronics, Ltd., U.S.A.). This test was considered as a test of pulverisability. In this measuring method, it can be said that when the volume average particle diameter is 12 μm or less, the pulverisability is good.

INDUSTRIAL APPLICABILITY

The toner composition and the resin for toner of the present invention are useful as a toner for developing electrostatic charge images and a resin for such toner which are excellent in low-temperature fixing ability and hot offset resistance.

The invention claimed is:

1. A resin for toner, the resin comprising a polyester resin (A) produced by reacting a polyester resin (a) having an acid value of 6 mgKOH/g or less and a hydroxyl value of 10 to 80 mgKOH/g with at least one carboxylic acid (b) selected from the group consisting of aliphatic carboxylic acids, aromatic carboxylic acids, their anhydrides and lower alkyl (C1-C4) esters, wherein the equivalent ratio OHa/COOHb is 0.55 to 1.0 where OHa represents the equivalent of the hydroxyl groups originating in (a) in the reaction of (a) and (b) and COOHb represents the equivalent of the carboxyl groups originating in (b) in the reaction of (a) and (b), wherein the polyester resin (A) has an acid value of 13 to 50 mgKOH/g and a hydroxyl value of 8 mgKOH/g or less, and wherein 30 to 100 mol % of the polyol component constituting the polyester resin (A) is an aliphatic diol having 2 to 6 carbon atoms.

2. The resin for toner according to claim 1, wherein the carboxylic acid (b) is a divalent or higher valent aromatic carboxylic acid.

3. The resin for toner according to claim 2, wherein the polyester resin (A) has a THF-insoluble matters in a content of 1 to 50% by weight.

4. The resin for toner according to claim 3, wherein the resin contains, together with the polyester resin (A), a polyester resin (B) other than the (A) which is free from any THF-insoluble matter.

5. The resin for toner according to claim 2, wherein the resin contains, together with the polyester resin (A), a polyester resin (B) other than the (A) which is free from any THF-insoluble matter.

6. The resin for toner according to claim 1, wherein the polyester resin (A) has a THF-insoluble matters in a content of 1 to 50% by weight.

7. The resin for toner according to claim 6, wherein the resin contains, together with the polyester resin (A), a polyester resin (B) other than the (A) which is free from any THF-insoluble matter.

8. The resin for toner according to claim 1, wherein the resin contains, together with the polyester resin (A), a polyester resin (B) other than the (A) which is free from any THF-insoluble matter.

9. A toner composition comprising the resin for toner according to claim 1, a colorant and, if necessary, one or more additives selected from mold release agents, charge control agents and fluidizing agents.

10. A resin for toner, the resin comprising a polyester resin (A') which has an acid value of 13 to 50 mgKOH/g and a hydroxyl value of 8 mgKOH/g or less and has a THF-insoluble matter in a content of 1 to 50% by weight, wherein 30 to 100 mol % of the polyol component constituting the (A') is an aliphatic diol having 2 to 6 carbon atoms and the carboxylic acid component constituting the (A') comprises a trivalent or higher valent aromatic polycarboxylic acid.

11. The resin for toner according to claim 10, wherein the resin contains, together with the polyester resin (A), a polyester resin (B) other than the (A) which is free from any THF-insoluble matter.

12. A toner composition comprising the resin for toner according to claim 10, a colorant and, if necessary, one or more additives selected from mold release agents, charge control agents and fluidizing agents.

* * * * *